US012495883B2

(12) United States Patent
Cheng et al.

(10) Patent No.: US 12,495,883 B2
(45) Date of Patent: Dec. 16, 2025

(54) MULTI-POCKET BAG

(71) Applicant: LULULEMON ATHLETICA CANADA INC., Vancouver (CA)

(72) Inventors: Warren Christopher Howren Cheng, Vancouver (CA); Tianfei Wang, Burnaby (CA)

(73) Assignee: LULULEMON ATHLETICA CANADA INC., Vancouver (CA)

( * ) Notice: Subject to any disclaimer, the term of this patent is extended or adjusted under 35 U.S.C. 154(b) by 232 days.

(21) Appl. No.: 18/339,924

(22) Filed: Jun. 22, 2023

(65) Prior Publication Data

US 2024/0423347 A1 Dec. 26, 2024

(51) Int. Cl.
*A45F 3/00* (2006.01)
*A45F 5/00* (2006.01)

(52) U.S. Cl.
CPC ..... *A45F 3/005* (2013.01); *A45F 5/1583* (2025.01)

(58) Field of Classification Search
CPC ..... A45F 3/02; A45F 3/005; A45F 5/1583
USPC ..... 224/581, 148.6, 681, 682, 236, 603; D3/202, 226
See application file for complete search history.

(56) References Cited

U.S. PATENT DOCUMENTS 3,321,120 A * 5/1967 Cunningham ..... A45F 3/04 224/245
4,613,039 A * 9/1986 Shaw ..... A47G 25/54 190/103
5,150,824 A 9/1992 Alvarez et al.
5,890,809 A * 4/1999 Nelson ..... A45F 3/00 224/664
5,964,384 A 10/1999 Young
6,305,587 B1 * 10/2001 Miller ..... G06F 1/1628 224/582
6,401,993 B1 * 6/2002 Andrino ..... A45F 5/00 D3/229
6,971,562 B2 * 12/2005 Willows ..... A45F 3/16 224/148.7
7,237,703 B1 * 7/2007 Nathan ..... A45F 3/16 224/148.7
8,104,654 B2 * 1/2012 Overton ..... A45F 3/14 224/664
8,820,367 B2 * 9/2014 Reyes ..... A45F 3/02 206/545

(Continued)

FOREIGN PATENT DOCUMENTS

DE 4436845 A1 4/1994

*Primary Examiner* — Justin M Larson

(57) ABSTRACT

Examples of multi-pocket bags are disclosed. The multi-pocket bag includes a body with first and second storage bags joined together at inner panels thereof, a foldable pocket bag outer panel connected to the inner panels of the first and second storage bags, at least one strap connected to the body, and a two-part fastener. The foldable pocket bag outer panel forms at least one foldable pocket bag with at least one entrance opening. The two-part fastener has a first part coupled to at least one edge of the first storage bag and a second part coupled to at least one edge of the second storage bag. When the two-part fastener is closed, the foldable pocket bag outer panel is folded between the inner panels of the first and second storage bags. When the two-part fastener is open, the foldable pocket bag outer panel is unfolded and in a suspended position.

20 Claims, 9 Drawing Sheets

(56) References Cited

U.S. PATENT DOCUMENTS

| | | | | | |
|---|---|---|---|---|---|
| 8,985,409 | B2 * | 3/2015 | Willows | A45F 5/00 | |
| | | | | 224/684 | |
| D771,369 | S * | 11/2016 | Willows | D3/202 | |
| D790,850 | S * | 7/2017 | Baldwin | D3/226 | |
| D909,054 | S * | 2/2021 | Huang | D3/226 | |
| D978,528 | S * | 2/2023 | Birdwell | D3/226 | |
| D1,000,102 | S * | 10/2023 | Weng | D3/226 | |
| 11,882,921 | B2 * | 1/2024 | Cope | A45F 3/02 | |
| 12,108,866 | B1 * | 10/2024 | Moraca | A45F 3/04 | |
| 12,137,783 | B2 * | 11/2024 | Aquino | A45F 3/04 | |
| 2016/0058142 | A1 | 3/2016 | Buynar | | |
| 2024/0423347 | A1 * | 12/2024 | Cheng | A45F 3/02 | |

* cited by examiner

MULTI-POCKET BAG

TECHNICAL FIELD

The present disclosure relates to a multi-pocket bag.

BACKGROUND

There are various pre-existing systems for allowing wearers to carry various items on their bodies, such as, for example, backpacks, purses and tote bags. Backpacks allow for items to be carried hands-free but the main body of the bag is adjacent to the back of the wearer and therefore, is not easily accessible. Backpacks are also designed to be worn in one configuration, with the two straps over the shoulders of the wearer. Purses and tote bags are used on one shoulder of the wearer and although the main pocket(s) of the bag are more easily accessible than a backpack, wearing the bag on one shoulder may be uncomfortable to the wearer, particularly when the bag is worn for longer periods of time.

Wearers often wish to carry various items with them, such as phones, wallets, snacks and water bottles, but do not wish to store these items in the same pocket, for security reasons and in case of spills, particularly for food and drink items. Furthermore, wearers may wish to adjust the number of pockets available depending on what items they are carrying.

Thus, there remains a need for bags with multiple pockets in which to carry various items, as well as bags that can be worn such that those items are easily accessible to a wearer. Furthermore, there remains a need for bags where the number of pockets that are easily adjustable, to customize the bag for the items the wearer is carrying.

SUMMARY OF THE APPLICATION

In various embodiments, the present disclosure provides multi-pocket bags that allow a wearer to easily access separately stored items. The number of accessible pockets may also be adjusted.

In one aspect, the present disclosure provides a multi-pocket bag, the multi-pocket bag comprising: a body, the body comprising: a first storage bag having an outer panel, an inner panel, a top edge, a bottom edge and an opening; and a second storage bag having an outer panel, an inner panel, a top edge, a bottom edge and an opening; the first and second storage bags being joined together at the inner panel of the first storage bag and the inner panel of the second storage bag; a foldable pocket bag outer panel having a first side connected to the inner panel of the first storage bag and a second side connected to the inner panel of the second storage bag, the foldable pocket bag outer panel forming at least one foldable pocket bag with at least one entrance opening; at least one strap connected to the body; and a two part fastener having a first fastening part coupled to at least one edge of the first storage bag and a second fastening part coupled to at least one edge of the second storage bag, wherein when the two part fastener is in a closed position, the foldable pocket bag outer panel is folded and positioned between the inner panels of the first and second storage bags, and when the two part fastener is in an open position, the foldable pocket bag outer panel is unfolded and in a suspended position such that a wearer can access the at least one foldable pocket bag.

In various embodiments, the first and second storage bags are joined together along at least a portion of the top edge of the first storage bag and a portion of the top edge of the second storage bag, and the two part fastener is attached along side and bottom edges of the first storage bag and the second storage bag.

In various embodiments, the at least one foldable pocket bag further comprises an internal wall within the at least one foldable pocket bag, splitting the at least one foldable pocket bag into two separate foldable pockets, and two entrance openings, one for each separate foldable pocket. For example, the two entrance openings may be located on opposite sides of the body and are defined by the inner panels of the first and second storage bags and the foldable pocket bag outer panel. In various embodiments, the internal wall may extend longitudinally across a length of the at least one foldable pocket bag. In various embodiments, the internal wall may extend diagonally across a length of the at least one foldable pocket bag. In various embodiments, the internal wall may traverse across a width of the at least one foldable pocket bag.

In various embodiments, and from a front view of the multi-pocket bag, a lower edge of the foldable pocket bag outer panel is located below the bottom edge of the outer panel of the first storage bag and the bottom edge of the outer panel of the second storage bag.

In various embodiments, the opening of the first storage bag is located adjacent the top edge of the first storage bag.

In various embodiments, the first storage bag further comprises a flap for covering the opening of the first storage bag. In various embodiments, the first storage bag further comprises a flap two part fastener, a first part of the flap two part fastener on the flap and a second part of the flap two part fastener on the outer panel of the first storage bag.

In various embodiments, the at least one foldable pocket bag further comprises a securing loop adjacent to the at least one entrance opening of the at least one foldable pocket bag. In various embodiments, the securing loop may further comprise an adjustor for adjusting a size of the securing loop.

In various embodiments, the at least one strap connected to the body extends from a first side of the body to a second side of the body.

In various embodiments, a length of the at least one strap is adjustable.

In various embodiments, the two part fastener comprises a zipper.

In various embodiments, the opening of the second storage bag is located adjacent the top edge of the second storage bag.

In various embodiments, the second storage bag further comprises a second storage bag fastener for the opening of the second storage bag.

In various embodiments, the first storage bag further comprises an interior pocket bag having an opening, the opening for the interior pocket bag on the inner panel of the first storage bag.

In various embodiments, the multi-pocket bag is a cross-body bag, a sling bag or a backpack.

In addition to the aspects and embodiments described above, further aspects and embodiments will become apparent by reference to the drawings and study of the following detailed description.

BRIEF DESCRIPTION OF THE DRAWINGS

Throughout the drawings, reference numbers may be re-used to indicate correspondence between referenced elements. The drawings are provided to illustrate example embodiments described herein and are not intended to limit the scope of the application. Sizes and relative positions of elements in the drawings are not necessarily drawn to scale. For example, the shapes of various elements and angles may be not drawn to scale, and some of these elements may be arbitrarily enlarged and positioned to improve drawing legibility.

In the accompanying drawings, which illustrate one or more exemplary embodiments.

DETAILED DESCRIPTION

Figure 1:
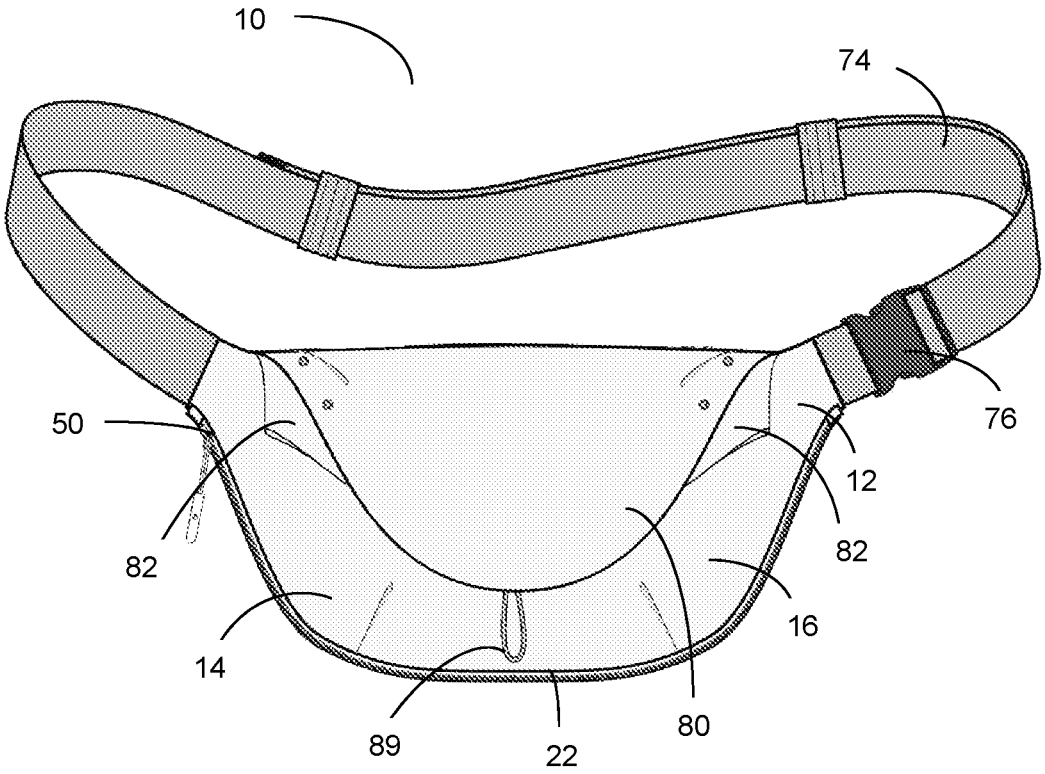
FIG. 1 is a front plan view of a multi-pocket bag in accordance with an embodiment of the invention, where a two part fastener of the multi-pocket bag is in a closed position.

In the following description, details are set forth to provide an understanding of the application. In some instances, certain structures, techniques, and methods have not been described or shown in detail in order not to obscure the application.

In the context of the present disclosure, various terms are used in accordance with what is understood to be the ordinary meaning of those terms.

Directional terms such as "top", "bottom", "front", "back", "upper", "lower", "outer" and "inner" are used in the following description for the purpose of providing relative reference only, and are not intended to suggest any limitations on how any article or garment is to be positioned during use, or to be mounted in an assembly or relative to an environment. The use of the word "a" or "an" when used herein in conjunction with the term "comprising" may mean "one", but it is also consistent with the meaning of "one or more", "at least one" and "one or more than one". Any element expressed in the singular form also encompasses its plural form. Any element expressed in the plural form also encompasses its singular form. The term "plurality" as used herein means more than one, for example, two or more, three or more, four or more, and the like.

The present disclosure relates to a multi-pocket bag. In various embodiments, the disclosure provides multi-pocket bags with different storage pockets for various items that are easily accessible to a wearer, and the number of accessible storage pockets can be modified. This modification allows the wearer to store different items in different pockets so that items are not damaged in case of spills or breaks, and to adjust the size of the multi-pocket bag depending on the type and number of items being carried.

Referring to FIGS. 1, 2, 3 and 5, and according to a first embodiment of the invention, a multi-pocket bag 10 is shown. The multi-pocket bag 10 comprises a body 12, the body 12 comprising a first storage bag 14 having an outer panel 16, an inner panel 18, a top edge 20, a bottom edge 22 and an opening 24. The body 12 also comprises a second storage bag 26, the second storage bag 26 having an outer panel 28, an inner panel 30, a top edge 32, a bottom edge 34 and an opening 36. The first storage bag 14 and the second storage bag 26 are joined together at the inner panel 18 of the first storage bag 14 and the inner panel 30 of the second storage bag 26. For example, and as shown in the Figures, the first storage bag 14 and the second storage bag 26 may be joined together along at least a portion of the top edge 20 of the first storage bag 14 and a portion of the top edge 32 of the second storage bag 26. In various embodiments, each of the outer panel 16 of the first storage bag 14, the inner panel 18 of the first storage bag 14, the outer panel 28 of the second storage bag 26, and the inner panel 30 of the second storage bag 14 may be comprised of one or more layers. Each of the outer panel 16 of the first storage bag 14, the inner panel 18 of the first storage bag 14, the outer panel 28 of the second storage bag 26, and the inner panel 30 of the second storage bag 14 may be of various shapes, depending on the size of the bag. An example shape of the inner panel 18 of the first storage bag 14 is shown in FIG. 6.

The multi-pocket bag 10 also includes a foldable pocket bag outer panel 38. The foldable pocket bag outer panel 38 has a first side 40 connected to the inner panel 18 of the first storage bag 14 and a second side 42 connected to the inner panel 30 of the second storage bag 26. The foldable pocket bag outer panel 38 forms at least one foldable pocket bag 44 with at least one entrance opening 46. In various embodiments, the foldable pocket bag outer panel 38 is a mesh. In various embodiments, the at least one entrance opening 46 is elastic.

Figure 2:
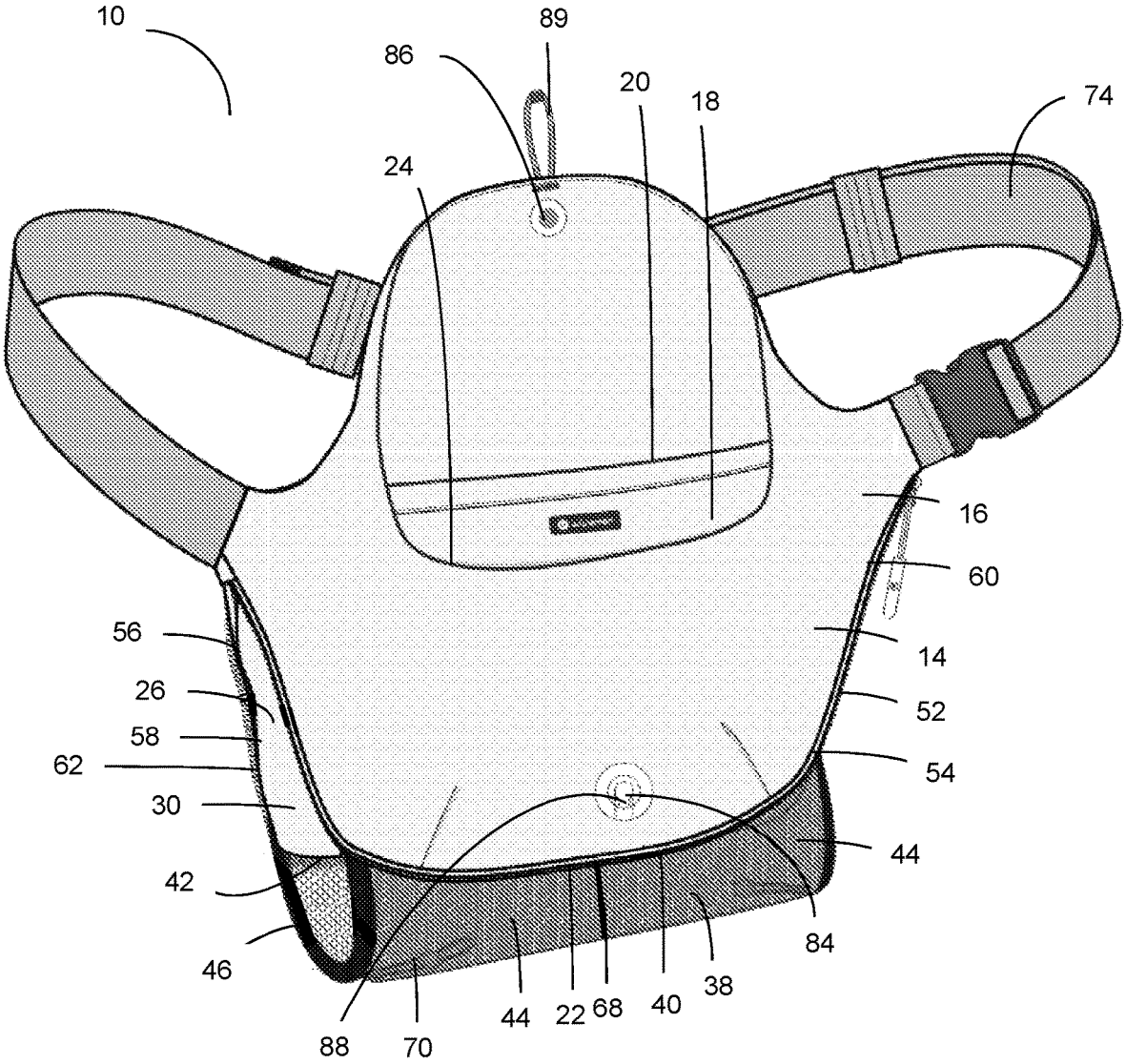
FIG. 2 is a front perspective view of a multi-pocket bag in accordance with an embodiment of the invention, where a two part fastener of the multi-pocket bag is in an open position with at least one foldable pocket bag accessible to a wearer, and a flap for covering an opening of a first storage bag is in an open position.
Figure 3:
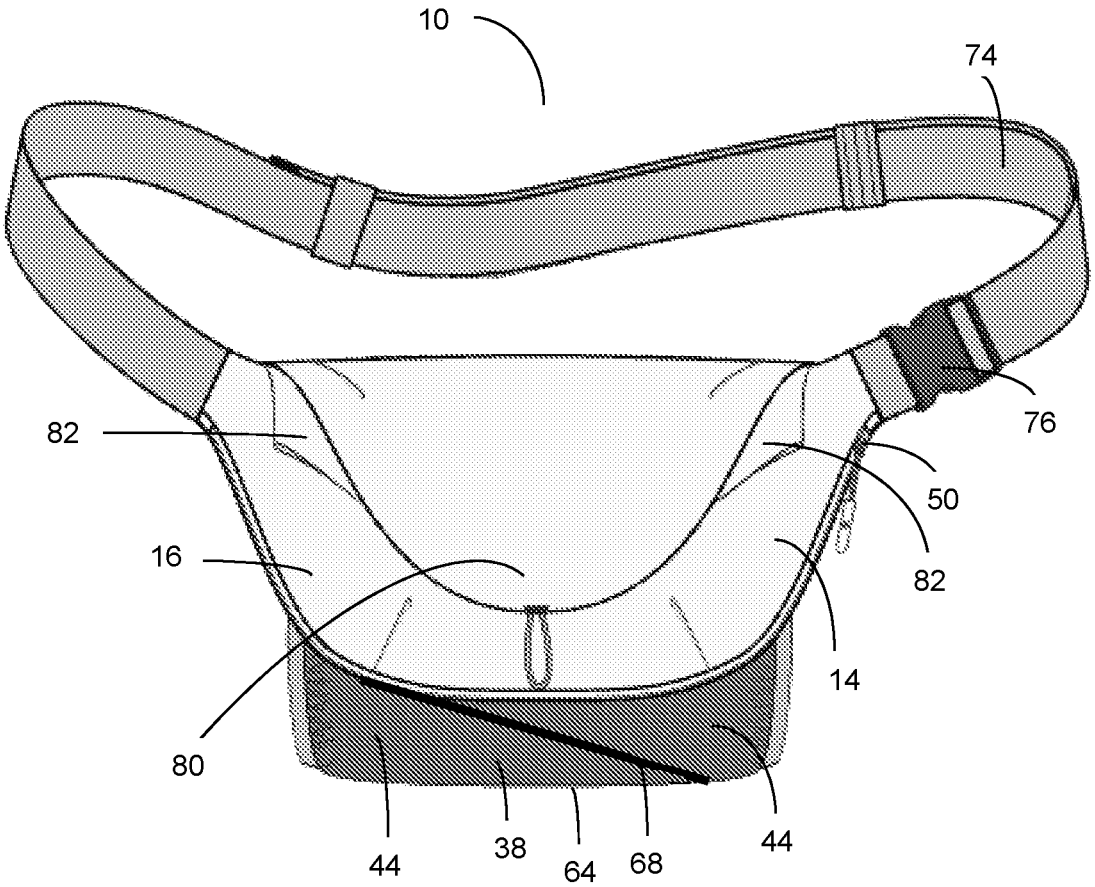
FIG. 3 is a front plan view of a multi-pocket bag in accordance with an embodiment of the invention, where a two part fastener of the multi-pocket bag is in an open position with the at least one foldable pocket bag accessible to a wearer, and a flap for covering an opening of a first storage bag is in a closed position.

In order to access the least one foldable pocket bag 44, the multi-pocket bag 10 includes a two part fastener 50 having a first fastening part 52 coupled to at least one edge 54 of the first storage bag 14 and a second fastening part 56 coupled to at least one edge 58 of the second storage bag 26. An example of the two part fastener 50 is a zipper. In various embodiments, the first fastening part 52 may be coupled along both side 60 and bottom 22 edges of the first storage bag 14 and the second fastening part 56 may be coupled along both side 62 and bottom 34 edges of the second storage bag 26. When the two part fastener 50 is in a closed position, as shown in FIG. 1, the foldable pocket bag outer panel 38 is folded and positioned between the inner panel 18 of the first storage bag 14 and the inner panel 30 of the second storage bag 26. When the two part fastener 50 is in an open position, the foldable pocket bag outer panel 38 is unfolded and in a suspended position as shown in FIGS. 2 and 3 such that a wearer can access the at least one foldable pocket bag 44. For example, in various embodiments, and from a front view of the multi-pocket bag 10, a lower edge 64 of the foldable pocket bag outer panel 38 may be located below the bottom edge 22 of the outer panel 16 of the first storage bag 14 and below the bottom edge 34 of the outer panel 28 of the second storage bag 26. In this way, the wearer can adjust the number of accessible pockets of the multi-pocket bag 10 by opening and closing the two part fastener 50.

Figure 10:
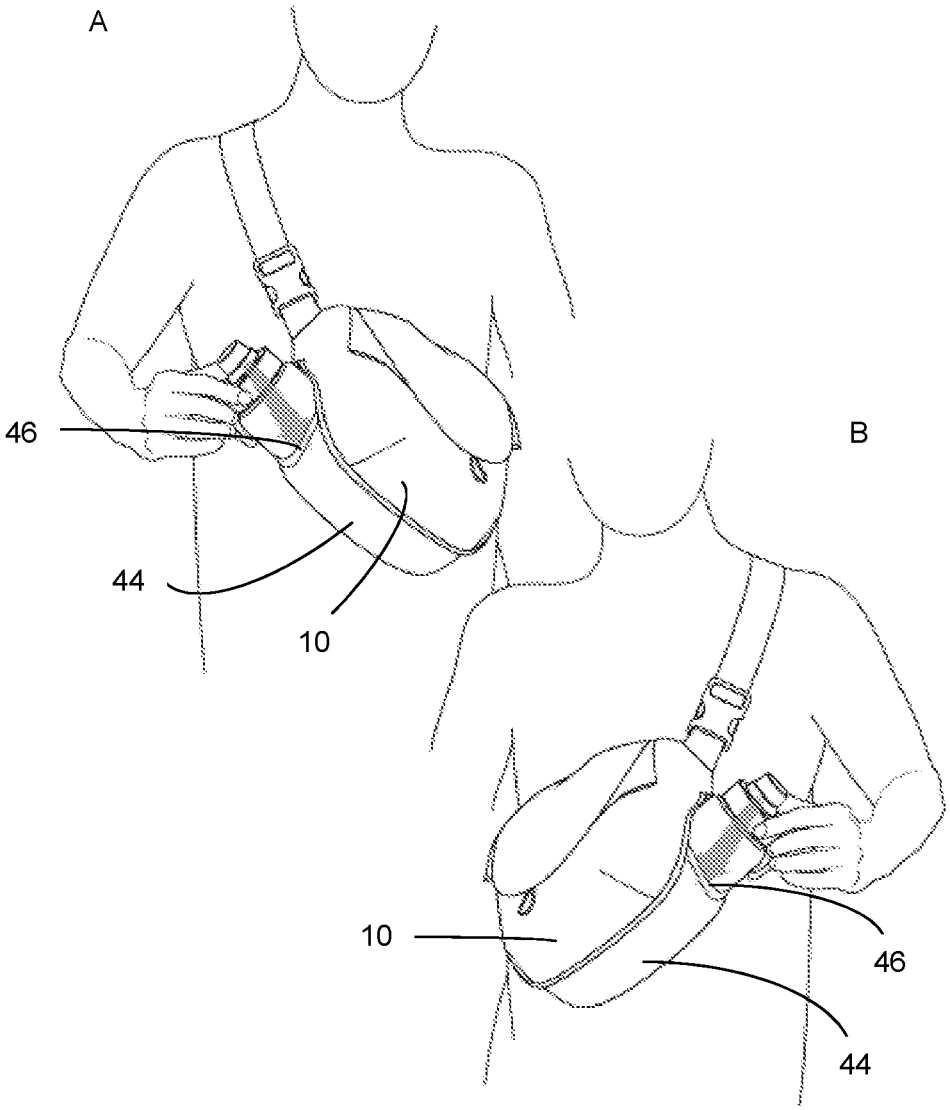
FIG. 10 is a front left (A) and a front right (B) perspective view of a multi-pocket bag in accordance with an embodiment of the invention being worn as a sling bag by a wearer, where a two part fastener of the multi-pocket bag is in an open position with an at least one foldable pocket bag in use by the wearer to contain a water bottle.

In various embodiments, the at least one foldable pocket bag 44 further comprises an internal wall 68 within the at least one foldable pocket bag 44. The internal wall 68 splits the at least one foldable pocket bag 44 into two separate foldable pocket bags 44. The two separate foldable pocket bags 44 are non-communicating and therefore, the at least one entrance opening 46 is two entrance openings 46, one for each separate foldable pocket bag 44. In the example shown in FIGS. 2 and 3, the two entrance openings 46 are located on opposite sides of the body 12 and are defined by the inner panel 18 of the first storage 14, the inner panel 30 of the second storage bag 26, and the foldable pocket bag outer panel 38. As shown in FIG. 10, the two foldable pocket bags 44 may be used to hold a bottle such as a water bottle. When the multi-pocket bag is worn as a cross-body bag, one of the two foldable pocket bags 44 is positioned with its entrance opening 46 upright, such that the bottle is held in an accessible and upright position against the wearer, and is less likely to spill. As shown in FIG. 10A, when the multi-pocket bag is worn across a right shoulder of the wearer, the foldable pocket bag 44 with an entrance opening 46 on the left side of the multi-pocket bag 10 is tilted upright and is accessible to the wearer. As shown in FIG. 10B, when the multi-pocket bag 10 is worn across a left shoulder of the wearer, the foldable pocket bag 44 with an entrance opening 46 on the right side of the multi-pocket bag 10 is tilted upright and is accessible to the wearer.

The internal wall 68 may have various configurations. For example, the internal wall 68 may extend longitudinally across a length of the at least one foldable pocket bag 44, such as diagonally across a length of the at least one foldable pocket bag 44, as shown in FIG. 3. Alternatively, the internal wall 68 may traverse across a width of the at least one foldable pocket bag 44, as shown in FIG. 2.

Figure 9:
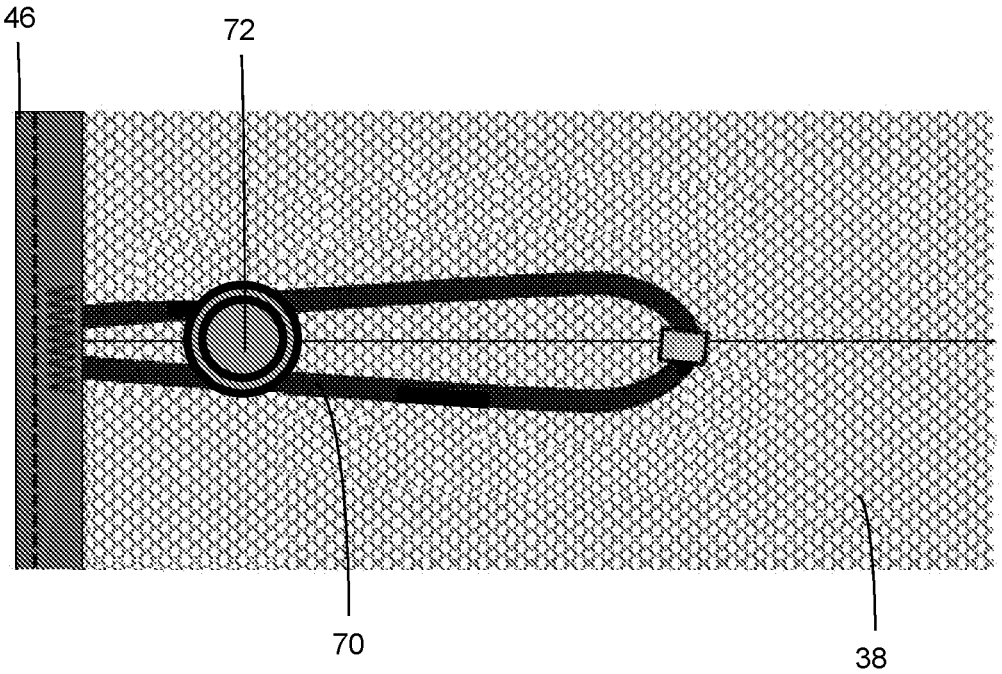
FIG. 9 is a side plan view of a securing loop of an at least one foldable pocket bag of a multi-pocket bag in accordance with an embodiment of the invention.
Figure 11:
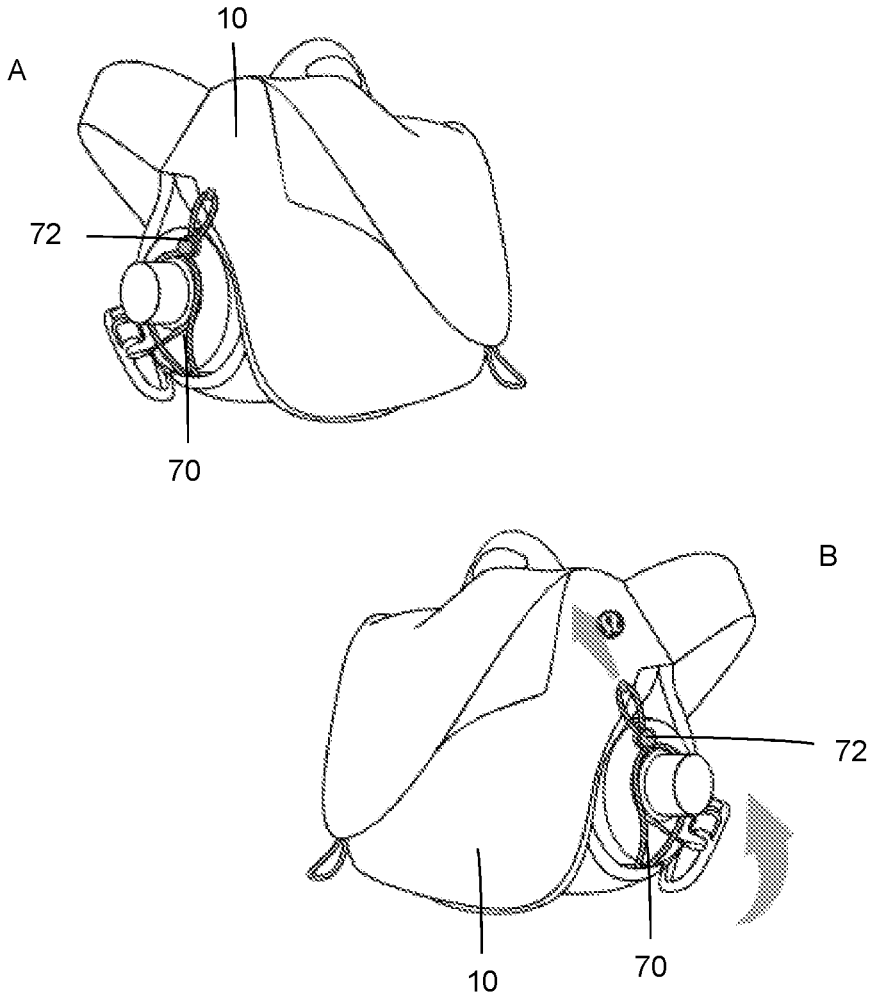
FIG. 11 is a front left (A) and a front right (B) perspective view of a multi-pocket bag in accordance with an embodiment of the invention, where a two part fastener of the multi-pocket bag is in an open position with an at least one foldable pocket bag in use by a wearer to contain a water bottle.

In order to further aid in securing items in the at least one foldable pocket bag 44, the at least one foldable pocket bag 44 may further comprise a securing loop 70 adjacent to the at least one entrance opening 46 of the at least one foldable pocket bag 44. The securing loop 70 is shown in FIGS. 2 and 9. The securing loop 70 may be made of various cord materials, such as, for example, paracord or shockcord, having different levels of elasticity. Use of the securing loop 70 to secure a water bottle in the at least one foldable pocket bag 44 is shown in FIG. 11. In various embodiments, the securing loop 70 may comprise an adjustor 72 for adjusting a size of the securing loop 70. When an item such as, for example, a bottle is place in the at least one foldable pocket bag 44, the securing loop 70 may be positioned around a neck of the bottle, as shown in FIG. 11A. In examples where the securing loop 70 also comprises an adjustor 72, the adjustor 72 may be pushed towards the neck of the bottle to more securely hold the bottle in position. The adjustor 72 may be held in place by friction, and moved along a length of the securing loop 70 by applying pressure against the adjustor 72 or by pulling on the securing loop 70.

At least one strap 74 is connected to the body 12. In various embodiments, the at least one strap 74 connected to the body 12 may extend from side-to-side of the body 12. In various embodiments, the at least one strap 74 may have an adjustable length. Alternatively or in addition, the at least one strap 74 may have a two part strap fastener 76 in order to open and close the strap. The at least one strap 74 may also be a handle 78 connected to the top edge 20 of the first storage bag 12 and/or the top edge 32 of the second storage bag 14. An example of the handle is shown in FIG. 5.

Figure 4:
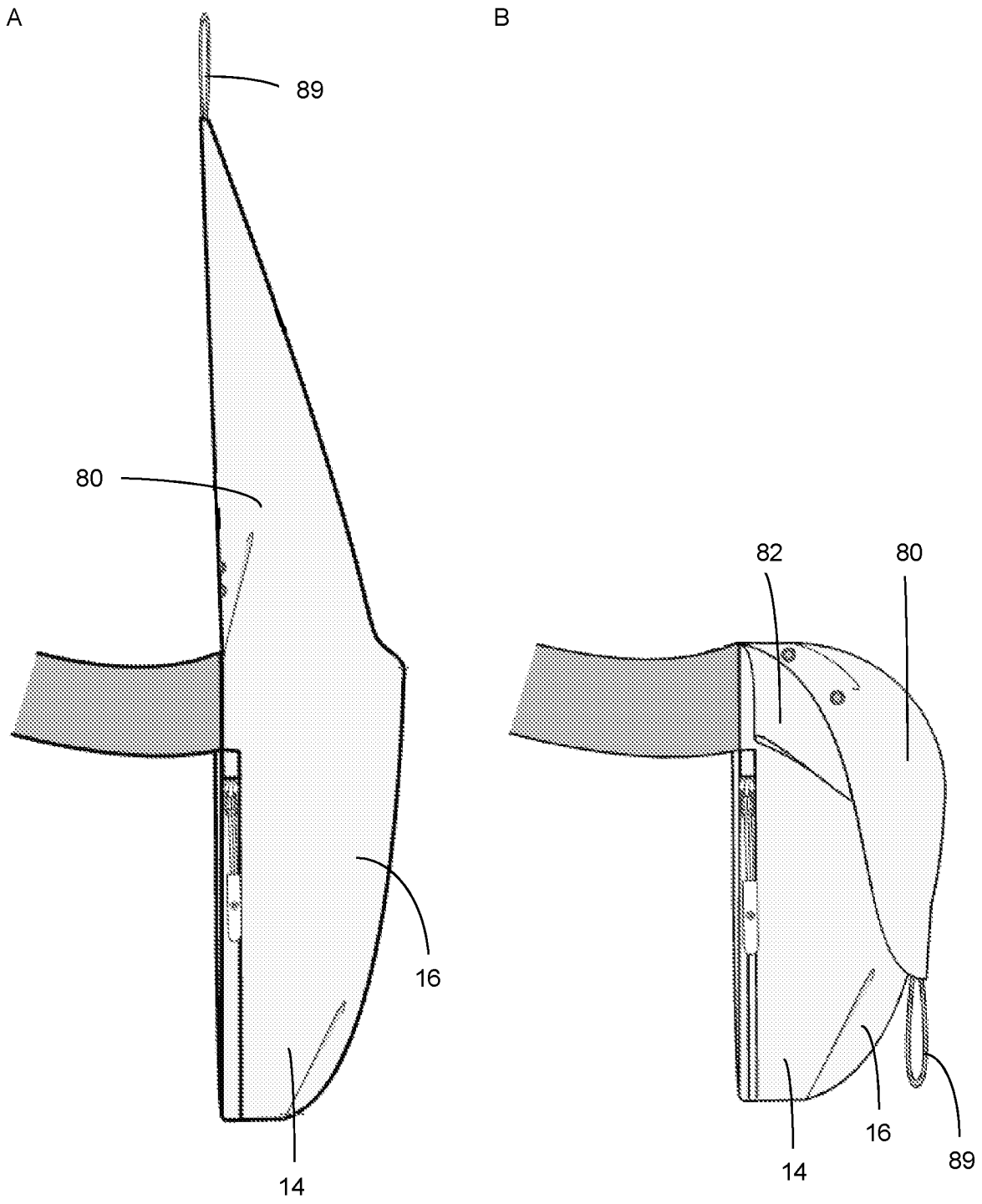
FIG. 4 is a side plan view of a multi-pocket bag in accordance with an embodiment of the invention, where a two part fastener of the multi-pocket bag is in a closed position, and a flap for covering an opening of a first storage bag is in an open position (A) and in a closed position (B).
Figure 8:
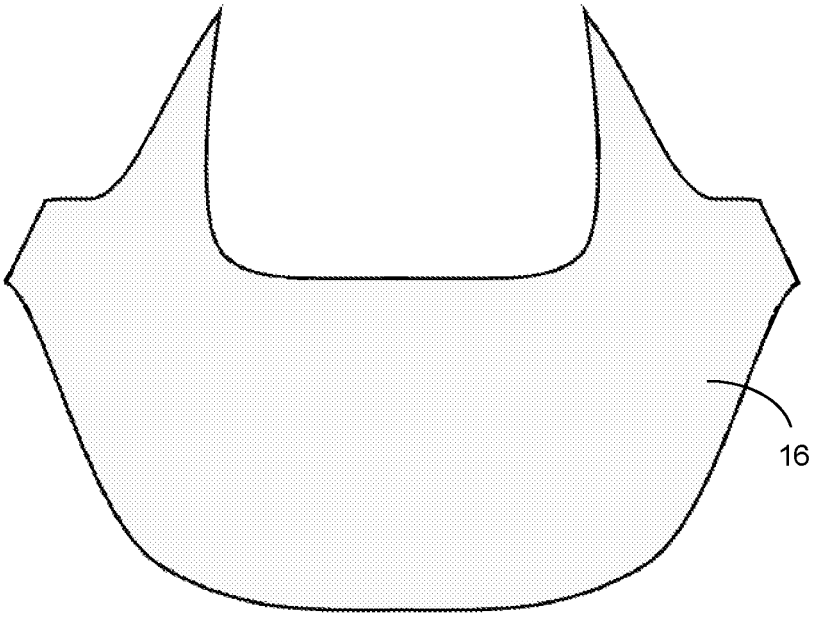
FIG. 8 is an interior view of an outer panel of a first storage bag of a multi-pocket bag in accordance with an embodiment of the invention.

The opening 24 of the first storage bag 14 may be located adjacent the top edge 20 of the first storage bag 14 as shown in FIG. 2. To assist in securing items within the first storage bag 14, the first storage bag 14 may further comprise a flap 80 for covering the opening 24 of the first storage bag 14. A side-view of the flap 80 is shown in FIG. 4, with the flap 80 in an open position in FIG. 4A, allowing the wearer to place items in the first storage bag 14. In FIG. 4B, the flap 80 is in a closed position. In various embodiments, and in order to more securely hold items in the first storage bag 14 and particularly to prevent items from falling out from the sides of the opening 24, the outer panel 16 of the first storage pocket may have a shape such that when the flap 80 is folded, side flaps 82 are formed, as shown in FIGS. 3 and 4B. An example shape for the outer panel 16 of the first storage pocket 14 is shown in FIG. 8. Alternatively or in addition, the first storage bag 14 may further comprise a flap two part fastener 84, with a first part 86 of the flap two part fastener 84 on the flap 80 and a second part 88 of the flap two part fastener 84 on the outer panel 16 of the first storage bag 14. In various embodiments, the flap two part fastener 84 may be a magnet, a snap or a button. In various embodiments, the flap 80 may further comprise a loop 89 that may be held by the user in order to aid in moving the flap 80 to the open position.

Figure 5:
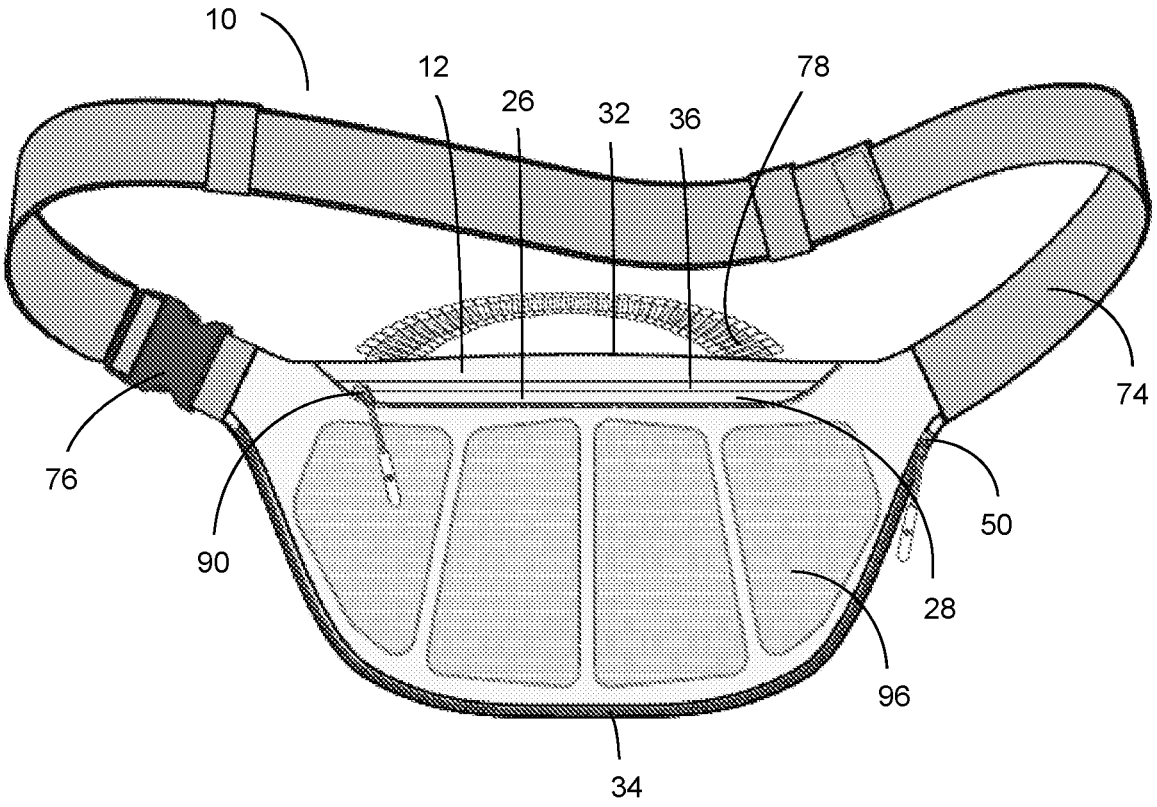
FIG. 5 is a back plan view of a multi-pocket bag in accordance with an embodiment of the invention.
Figure 6:
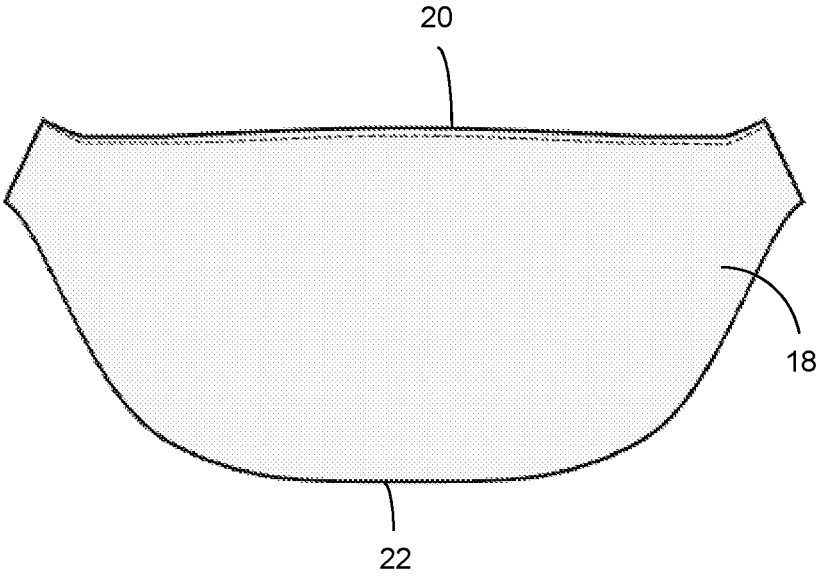
FIG. 6 is an interior view of an inner panel of a first storage bag of a multi-pocket bag in accordance with an embodiment of the invention.

The opening 36 of the second storage bag 26 may be located adjacent the top edge 32 of the second storage bag 26 as shown in FIG. 5. In various embodiments, the second storage bag 26 may comprise a second storage bag fastener 90 for opening and closing the opening 36 of the second storage bag 26. For example, the second storage bag fastener 90 may be a zipper, as shown in FIG. 5.

Figure 7:
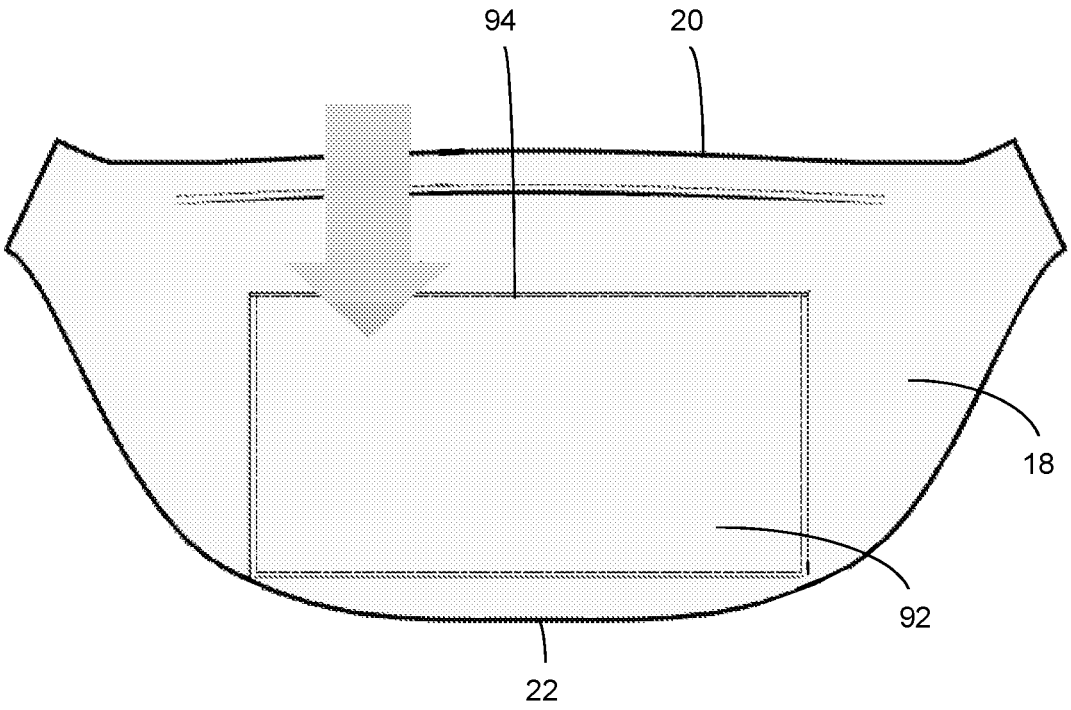
FIG. 7 is an interior view of an inner panel of a first storage bag of a multi-pocket bag in accordance with an embodiment of the invention, the first storage bag further comprising an interior pocket bag on the inner panel, the interior pocket bag having an opening along a top edge of the interior pocket bag.

In various embodiments, the first storage bag 14 and the second storage bag 26 may contain internal pocket bags. For example, as shown in FIG. 7, the inner panel 18 of the first storage bag 26 may comprise an interior pocket bag 92 having an opening 94. The opening 94 may be along a top edge of the interior pocket bag 92, thereby forming a slip pocket. A similar internal pocket bag may also be located in the second pocket bag 26.

The outer panel 28 of the second pocket may further comprise exterior cushioning 96. The exterior cushioning may increase comfort of multi-pocket bag 10 against the body of the wearer. The exterior cushioning 96 may comprise separate panels such that the exterior cushioning wraps around the body of the wearer. In various embodiments, the exterior cushioning 96 may comprise padded mesh. In various embodiments, the exterior cushioning 96 may comprise a foam material.

In various embodiments, the body 12 and the components thereof may be made of any suitable material for a bag, such as, for example, polyester or recycled polyester, or any other synthetic polymer, biopolymer or natural fiber material.

FIG. 10 shows the multi-pocket bag 10 as being a cross-body bag, however, the multi-pocket bag may also be a sling bag or a backpack.

While particular elements, embodiments and applications of the present application have been shown and described, it will be understood, that the scope of the application is not limited thereto, since modifications can be made by those skilled in the art without departing from the scope of the present application, particularly in light of the foregoing teachings. Thus, for example, in any method or process disclosed herein, the acts or operations making up the method/process may be performed in any suitable sequence and are not necessarily limited to any particular disclosed sequence. Elements and components can be configured or arranged differently, combined, and/or eliminated in various embodiments. The various features and processes described above may be used independently of one another, or may be combined in various ways. All possible combinations and subcombinations are intended to fall within the scope of this application. Reference throughout this disclosure to "some embodiments," "an embodiment," or the like, means that a particular feature, structure, step, process, or characteristic described in connection with the embodiment is included in at least one embodiment. Thus, appearances of the phrases "in some embodiments," "in an embodiment," or the like, throughout this disclosure are not necessarily all referring to the same embodiment and may refer to one or more of the same or different embodiments. Indeed, the novel methods and systems described herein may be embodied in a variety of other forms; furthermore, various omissions, additions, substitutions, equivalents, rearrangements, and changes in the form of the embodiments described herein may be made without departing from the spirit of the application.

Various aspects and advantages of the embodiments have been described where appropriate. It is to be understood that not necessarily all such aspects or advantages may be achieved in accordance with any particular embodiment. Thus, for example, it should be recognized that the various embodiments may be carried out in a manner that achieves or optimizes one advantage or group of advantages as taught herein without necessarily achieving other aspects or advantages as may be taught or suggested herein.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without operator input or prompting, whether these features, elements and/or steps are included or are to be performed in any particular embodiment. No single feature or group of features is required for or indispensable to any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

The example calculations, simulations, results, graphs, values, and parameters of the embodiments described herein are intended to illustrate and not to limit the disclosed embodiments. Other embodiments can be configured and/or operated differently than the illustrative examples described herein.

What is claimed is:

1. A multi-pocket bag, the multi-pocket bag comprising:

a body, the body comprising:

a first storage bag having an outer panel, an inner panel, a top edge, a bottom edge and an opening; and a second storage bag having an outer panel, an inner panel, a top edge, a bottom edge and an opening;

the first and second storage bags being joined together at the inner panel of the first storage bag and the inner panel of the second storage bag;

a foldable pocket bag outer panel having a first side connected to the inner panel of the first storage bag and a second side connected to the inner panel of the second storage bag, the foldable pocket bag outer panel forming at least one foldable pocket bag with at least one entrance opening, wherein the at least one entrance opening is defined by the first storage bag, the second storage bag, and the foldable pocket bag outer panel;

at least one strap connected to the body; and a two part fastener having a first fastening part coupled to the bottom edge of the first storage bag and a second fastening part coupled to the bottom edge of the second storage bag, wherein when the two part fastener is in a closed position, the foldable pocket bag outer panel is folded and positioned between the inner panels of the first and second storage bags, and when the two part fastener is in an open position, the foldable pocket bag outer panel is unfolded and in a suspended position such that a wearer can access the at least one foldable pocket bag.

2. The multi-pocket bag of claim 1, wherein the first and second storage bags are joined together along at least a portion of the top edge of the first storage bag and a portion of the top edge of the second storage bag, and the two part fastener is attached along side and bottom edges of the first storage bag and the second storage bag.

3. The multi-pocket bag of claim 1, wherein from a front view of the multi-pocket bag, a lower edge of the foldable pocket bag outer panel is located below the bottom edge of the outer panel of the first storage bag and the bottom edge of the outer panel of the second storage bag.

4. The multi-pocket bag of claim 1, wherein the at least one strap connected to the body extends from a first side of the body to a second side of the body.

5. The multi-pocket bag of claim 1, wherein a length of the at least one strap is adjustable.

6. The multi-pocket bag of claim 1, wherein the two part fastener comprises a zipper.

7. The multi-pocket bag of claim 1, wherein the first storage bag further comprises an interior pocket bag having an opening, the opening for the interior pocket bag on the inner panel of the first storage bag.

8. The multi-pocket bag of claim 1, wherein the multi-pocket bag is a cross-body bag, a sling bag or a backpack.

9. The multi-pocket bag of claim 1, wherein the at least one foldable pocket bag further comprises an internal wall within the at least one foldable pocket bag, splitting the at least one foldable pocket bag into two separate foldable pockets, and two entrance openings, one for each separate foldable pocket.

10. The multi-pocket bag of claim 9, wherein the two entrance openings are located on opposite sides of the body and are defined by the inner panels of the first and second storage bags and the foldable pocket bag outer panel.

11. The multi-pocket bag of claim 10, wherein the internal wall extends longitudinally across a length of the at least one foldable pocket bag.

12. The multi-pocket bag of claim 10, wherein the internal wall extends diagonally across a length of the at least one foldable pocket bag.

13. The multi-pocket bag of claim 10, wherein the internal wall traverses across a width of the at least one foldable pocket bag.

14. The multi-pocket bag of claim 1, wherein the opening of the first storage bag is located adjacent the top edge of the first storage bag.

15. The multi-pocket bag of claim 14, wherein the first storage bag further comprises a flap for covering the opening of the first storage bag.

16. The multi-pocket bag of claim 15, wherein the first storage bag further comprises a flap two part fastener, a first part of the flap two part fastener on the flap and a second part of the flap two part fastener on the outer panel of the first storage bag.

17. The multi-pocket bag of claim 1, wherein the at least one foldable pocket bag further comprises a securing loop adjacent to the at least one entrance opening of the at least one foldable pocket bag.

18. The multi-pocket bag of claim 17, wherein the securing loop further comprises an adjustor for adjusting a size of the securing loop.

19. The multi-pocket bag of claim 1, wherein the opening of the second storage bag is located adjacent the top edge of the second storage bag.

20. The multi-pocket bag of claim 19, wherein the second storage bag further comprises a second storage bag fastener for the opening of the second storage bag.

* * * * *